US005937656A

United States Patent [19]

Cheng et al.

[11] Patent Number: 5,937,656

[45] Date of Patent: Aug. 17, 1999

[54] NONFREEZING HEAT EXCHANGER

[75] Inventors: Alan Tat Yan Cheng, Livingston, N.J.; Donald Leonard Devack, Norwalk, Conn.

[73] Assignee: Praxair Technology, Inc., Danbury, Conn.

[21] Appl. No.: 08/852,813

[22] Filed: May 7, 1997

[51] Int. Cl.[6] ..... F17C 9/02

[52] U.S. Cl. ..... 62/50.2; 62/903

[58] Field of Search ..... 62/50.2, 51.1, 62/643, 903

[56] References Cited

U.S. PATENT DOCUMENTS

| | | | |
|---|---|---|---|
| 3,724,426 | 4/1973 | Brown | 62/50.2 X |
| 3,986,340 | 10/1976 | Bivins, Jr. | 62/50.2 |
| 4,170,115 | 10/1979 | Ooka et al. | 62/50.2 |
| 4,224,802 | 9/1980 | Ooka | 62/50.2 |
| 4,343,156 | 8/1982 | Gauthier | 62/50.2 |
| 5,163,303 | 11/1992 | Miyata et al. | 62/50.2 |
| 5,390,500 | 2/1995 | White et al. | 62/50.2 |
| 5,456,084 | 10/1995 | Lee | 62/51.1 |

*Primary Examiner*—Christopher B. Kilner
*Attorney, Agent, or Firm*—Robert J. Follett

[57] ABSTRACT

A heat exchanger unit having a housing into which a cryogenic liquid is introduced and permitted to evaporate and vaporize into a cryogenic cold gas. A process fluid to be cooled flows in a heat exchanger and heat exchange to cool the process fluid takes place between the cold gas and the heat exchanger, without making direct contact between the cryogenic liquid and the heat exchanger which would cause freezing. The refrigerating capacity of the cryogenic cold gas is replenished by heat exchange contact with the evaporating cryogenic liquid.

19 Claims, 4 Drawing Sheets

NONFREEZING HEAT EXCHANGER

FIELD OF THE INVENTION

The invention relates to a heat exchanger unit for cooling a process fluid without freezing of heat exchanger components.

BACKGROUND OF THE INVENTION

Cryogenic liquids, such as liquid nitrogen, have been used successfully in a number of low-temperature freezing operations such as food or biological materials freezing. In theory, it was recognized that a number of chemical and pharmaceutical processes also could benefit from cryogenic liquid cooling due to the low temperatures and high driving force afforded by cryogenic liquids. However, use of cryogenic liquids in low-temperature chemical processes has been limited because the low temperature and high driving force can cause the process fluid to freeze. Freezing of the process fluid in chemical operations is undesirable and can be hazardous, especially if the refrigeration is used to control exothermic reactions.

One conventional attempt to avoid the problem of process fluid freezing is to design an oversized shell-and-tube heat exchanger. A heat transfer fluid or reactant is pumped into the tube side under high velocity. A cryogenic liquid, such as liquid nitrogen, is either sprayed or flooded onto the shell side of the heat exchanger. In this type of heat exchanger freezing of the heat transfer fluid will occur as the liquid nitrogen downloads its latent heat of vaporization on the metal surfaces of the tube and shell. When the ice starts to grow and propagate, the heat transfer surface will lose its thermal conductivity. The result is either a rapid loss of heat transfer capacity or a total freezing of the entire contents of the heat exchanger. Upon freezing, the unit must be defrosted before it can be put back to service. For chemical reactions or more generally for heat transfer applications that require a very short batch time (of the order, e.g., of 10–15 minutes), an oversized heat exchanger may provide a solution, as it may remain functional for a limited time before losing its capability to provide effective heat transfer. But if the batch time is significantly longer (e.g. 1 hour) the already oversize heat exchanger needs to be 4–6 times bigger to accomplish the same result (refrigerate the process fluid) without freezing, which prohibitively adds to the cost.

Another conventional approach is to mix the liquid nitrogen with room temperature nitrogen gas to reduce the refrigerant driving force and produce a cryogenic gas at a temperature warmer than −320° F., the condensation temperature for nitrogen at 1 atm pressure since the cryogenic cold gas can be kept as warm as necessary to avoid the freezing problem. In this approach, however, all of the latent heat of vaporization is lost in the mixing process. Furthermore, the nitrogen consumption rate is normally too high to be economically acceptable. In other words, because of the low driving force and unavailability of a phase change (vaporization), an unacceptably high amount of nitrogen gas is required to implement the cooling operation without freezing. Furthermore, the cold gas mixture will lose its sensible heat very rapidly due to its low heat capacity, which makes it unacceptable for many heat transfer applications.

Other prior art systems have mixed spent cryogenic gas with the incoming cryogenic liquid to provide a resulting mixture of cryogenic cold gas. However, only the sensible heat component of the cryogenic cold gas contributes to refrigeration. As a result, the mixture loses its refrigeration ability very rapidly (as was the case when cryogenic liquid was mixed with room temperature gas, described above) and uniform cooling becomes very difficult. Also, the large volume of gas (caused by the combination of the evaporating liquid nitrogen and the added spent cryogenic gas) causes an excessive pressure drop and increases operating cost.

OBJECTIONS OF THE INVENTION

It is therefore an object of the invention to provide a heat exchanger unit and heat exchange method for a process fluid that operates with a cryogenic liquid but does not cause the process fluid to freeze, and is economical to operate.

It is another object of the invention to provide a heat exchanger unit and heat exchange method for a process fluid employing a cryogenic cold gas as the refrigerant in contact with a conduit in which the process fluid flows wherein the heat transfer rate from the cold gas to the process fluid throughout the heat transfer process decreases only by a small amount.

Another object is to provide a heat exchanger unit and method operating with a cryogenic liquid in which the cryogenic liquid is converted to a cold gas which is both cooled by the cryogenic liquid and brought into contact with a conduit carrying the process fluid to be cooled to effect heat exchange and cool the fluid.

A further object is to provide a heat exchanger unit and method in which a cryogenic liquid is vaporized into a cold gas in a housing and contacts a heat exchanger carrying the process fluid to be cooled in which the cold gas is caused to flow in a direction counter to the flow of the process fluid and to thereby both cool the fluid and absorb refrigerant capacity from the liquid.

Another object is to provide a heat exchanger unit and method using a cryogenic liquid that will convert all the latent heat of vaporization of the cryogenic liquid into sensible heat without having to mix the cryogenic liquid with a spent cold gas (which increases the volume of the refrigerant).

Still a further object is to provide a heat exchange unit and method in which there is a re-supply of refrigeration to a vaporized cryogenic cold gas that performs the cooling so that the sensible heat can be maintained to provide uniform cooling.

BRIEF DESCRIPTION OF THE DRAWINGS

Other objects and advantages of the invention will become more apparent upon reference to the following specification and annexed drawings in which.

BRIEF DESCRIPTION OF THE INVENTION

Figure 1:
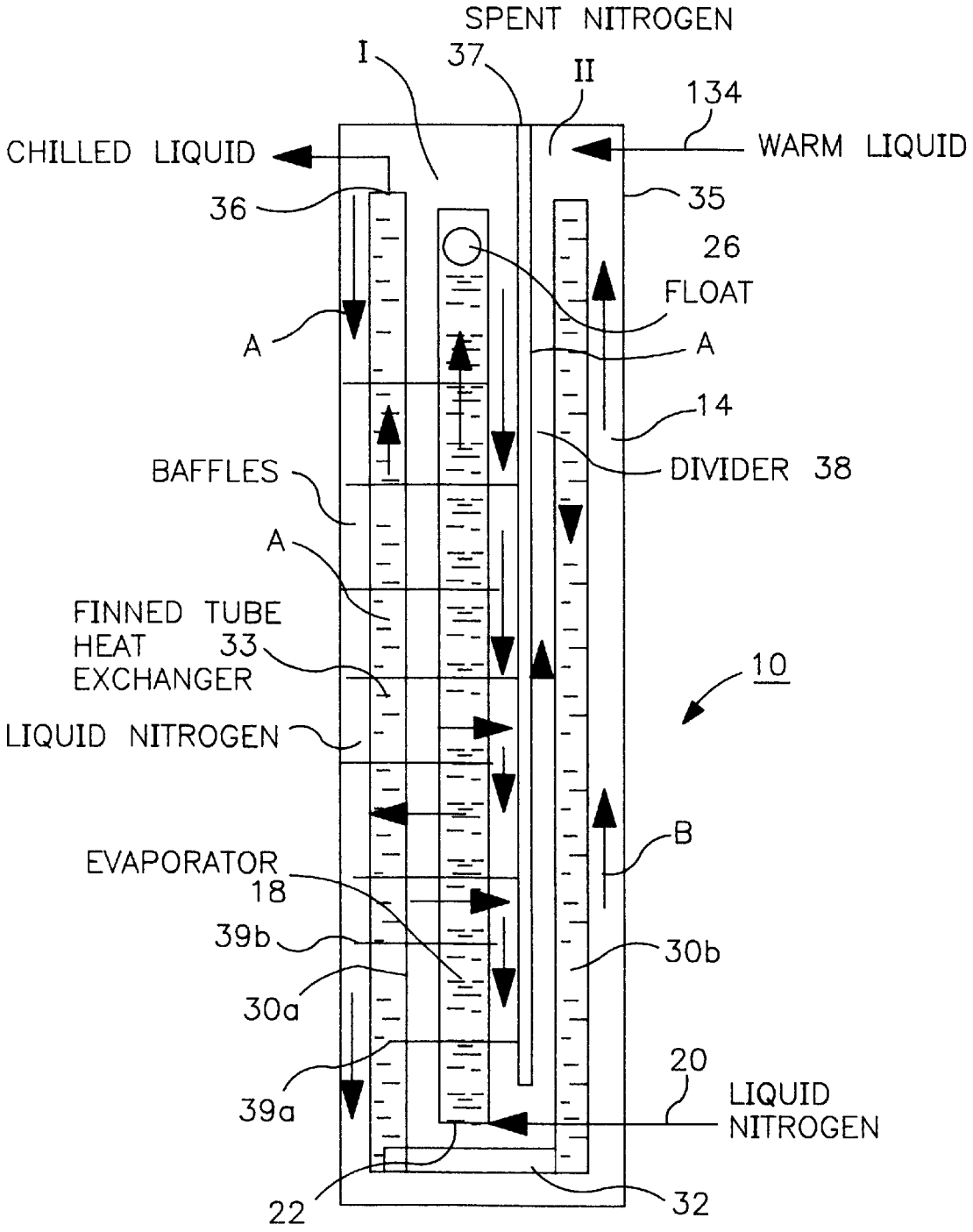
FIG. 1 is a schematic diagram of a first embodiment of heat exchanger unit in accordance with the invention.

Most freezing occurs because the cryogenic liquid boils (vaporizes) and downloads its latent heat of vaporization rapidly when it comes in contact with a warmer surface such as the wall of a heat exchanger. The latent heat of vaporization accounts for more than half of all the refrigeration available from a cryogenic liquid. Therefore, a very small section of the warmer surface can become extremely cold very rapidly during the initial contact with the liquid nitrogen which will start the freezing process. Furthermore, both the heat transfer coefficient and the specific heat of the liquid nitrogen is hundreds of times greater than that of cryogenic cold nitrogen gas which makes for efficient heat transfer but contributes to the freezing problem. Thus, the same properties of cryogenic liquids that contribute to the efficiency of heat transfer also contribute to the problem of freezing of the process fluid.

The present invention avoids direct contact between the conduit that contains the process fluid and the cryogenic liquid, thereby avoiding freezing of the process fluid. Moreover, the present invention compensates for the poor heat transfer co-efficient of the cold gas (in cooling the process liquid) by keeping the cold gas at a low temperature (through contact with the conduit containing the cryogenic liquid) and thereby maintaining a good driving force and a good heat transfer rate.

The present invention provides a heat exchanger unit in which there is no direct contact of the cryogenic liquid, for example, liquid nitrogen, with the surface (usually metal) of the conduit in which the process fluid is flowing. This prevents the heat exchanger from freezing. To accomplish this, the invention provides a heat exchanger unit in which the cryogenic liquid is caused to boil off prior to contact with the heat exchanger surface for the process fluid. The cryogenic liquid vaporizes into a cold gas, so that it is the cold gas, and not the cryogenic liquid, that mediates the heat exchange with the process fluid. Thus, the surface of any equipment component, such as a heat exchanger tube, containing the process fluid is contacted only by the vaporized cryogenic cold gas, and not by the cryogenic liquid itself. Since the process fluid has a much higher heat capacity per unit volume than the cryogenic gas, the process fluid can and does to absorb all the sensible heat from the cryogenic cold gas without freezing.

According to the invention, a heat exchanger unit includes a housing. The housing comprises an evaporator in which the cryogenic liquid is received, vaporizes and is discharged as a cold gas (vapor) in the housing. At least one heat exchanger tube carrying the process fluid is within the housing and is contacted by the cold gas to make the heat exchange and cool the process fluid.

In a preferred embodiment, the cold gas mediating the heat exchange is forced to pick up additional refrigeration from the boiling liquid nitrogen by making it flow back past the evaporator. The vaporized cold gas traverses a serpentine path (preferably created by providing baffles in the housing) between the evaporator and heat exchanger tube to undergo a number of warming and chilling cycles to convert the latent heat of vaporization into the more manageable sensible heat. This avoids the problem of having the cryogenic cold gas warm up too rapidly which would result in poor exchanger performance due to a poor heat transfer rate of the vaporized cryogenic liquid gas (which has very low heat capacity per unit volume). The heat exchanger tube is preferably provided with fins to improve the heat exchange. The fins are arranged substantially at right angles to the cold gas flow.

In another aspect, the invention is directed to a process for cooling a flowing process fluid comprising the steps of: (i) flowing a cold gas refrigerant comprising a vaporized cryogenic liquid (a) in a first heat exchange relationship with said process fluid thereby cooling said process fluid and (b) in a second heat exchange relationship with said cryogenic liquid causing said liquid to vaporize and form additional cold gas and employing the heat of vaporization of said liquid to replenish the ability of said refrigerant to cool said process fluid.

DETAILED DESCRIPTION OF THE INVENTION

Throughout the present description use of the words "vertical" and "horizontal" and derivatives thereof is merely descriptive and is not intended as a limitation of the apparatus and process of the present invention. Moreover, although the present invention is described essentially only in terms of countercurrent flow patterns, it is not limited to such patterns, although they are preferred.

Referring to FIG. 1, the heat exchanger unit 10 has a housing 14 of any suitable size and shape, a typical shape being cylindrical. The exterior of housing 14 is preferably insulated with any suitable material. Within the housing is a vertically extending tube 18 of a suitable shape and diameter that serves as an evaporator. That is, evaporator 18 receives a cryogenic liquid refrigerant, such as liquid nitrogen, from an external source (not shown) over a line 20 to an input 22 at its bottom end. The cryogenic liquid boils (warms) as it travels upwardly through the evaporator and vaporizes to produce a cold gas that exits from the upper end of the evaporator into the housing. The upper end of evaporator (optionally) has at its outlet a float valve 26, the function of which is described below.

Also within housing 14 are a pair of vertically extending heat exchanger tubes 30*a* and 30*b* whose bottom ends are connected by a pipe section 32 at the lower part of the housing. While only two heat exchanger tubes are shown in the illustrated embodiment of the invention, additional tubes can be used. Each of the heat exchanger tubes 30 has horizontally extending fins 33 along its length to improve the heat exchange function. The warm process fluid which is to be cooled is supplied from a source (not shown) over an input line 34 to the upper end of the heat exchanger tube 30*b*. The process fluid can be either a liquid or a gas, with a liquid being the more common application and described herein in the illustrated embodiment of the invention. The process liquid flows downwardly in tube 30*b*, across pipe 32, upwardly through exchanger tube 30*a* and exits from the upper end 36 of tube 30*a* as a chilled liquid.

A vertically extending divider 38 is suspended from the top of housing 14 located between the evaporator 18 carrying the cryogenic liquid and the heat exchanger tube 30*b* to divide the housing interior into two sections, designated I and II. The purpose of the divider is described below. In Section I, a plurality of baffles 39*a* extend horizontally, that is, transverse to the evaporator 18 and heat exchanger tube 30*a*, within housing section I from the divider 38 toward, but terminating short of, the inner wall of housing 14. Additional horizontal baffles 39*b* also extend in housing section I from the inner wall of the housing toward, but terminating short of, the divider 38. Baffles 39*a* and 39*b* alternate forming an obstructed, serpentine-type, flow path, as shown by arrows A, from top to bottom of housing section I.

All of the components of the heat exchanger unit within the housing 14 are of materials that are suitable for the types of liquids being processed and can withstand the cryogenic liquid and cold gas processing temperatures. The metal components, such as the heat exchanger tubes 30, are selected and constructed so as to have good heat exchange capability.

In the system of FIG. 1 the cryogenic liquid is introduced from conduit 20 to the inlet 22 of the evaporator 18. As the liquid travels upwardly in evaporator 18 it boils and vaporizes and exits from vaporizer upper end 26 as a cold gas, here cold nitrogen. The cold gas leaving the top of evaporator 18 travels, as shown by the arrows A, downwardly in a counter-current direction to the cryogenic liquid flowing upwardly in the evaporator. The cold gas flows both downwardly and in a cross flow direction around the baffles 39.

In case of process upset, that is, in the event the pressure in housing 14 becomes greater than the pressure of the cryogenic liquid and vapor in evaporator 18, the float 26 on the top of the evaporator will keep the cryogenic liquid from escaping from the evaporator and flooding the heat exchanger housing.

In housing section I, process fluid flowing in the finned tube heat exchanger 30*a* will pick up refrigeration from (transfer heat to) the cold nitrogen gas flowing in the housing in a counter-current flow to the process fluid. The heat capacity of the cryogenic cold gas is small (compared to that of the process fluid) and therefore the cold gas will tend to warm up rapidly. The baffles 39 however force the downwardly flowing cold gas to pick up additional refrigeration during its counter flow pattern directly from the cold evaporator 18. Also, the baffles increase the travel time of the cold gas in the housing and prolong the contact with the cold evaporator. This not only serves to maintain the temperature and refrigeration value of the cold gas, it also warms up the evaporator tube 18 and causes the cryogenic liquid in tube 18 to boil. The low temperature of the cold gas thus is maintained and its temperature decreases linearly and slowly as the cold gas travels down the heat exchanger unit housing such that it is easily possible to maintain a substantial $\Delta T$ between the cold gas and the process fluid e.g. a $\Delta T$ greater than 50% of the initial $\Delta T$ (and preferably at least 80% or 90% of the initial $\Delta T$) throughout the twin heat transfer portion (cold gas-to-process fluid and cryogenic liquid-to-cold gas) of the heat transfer process (e.g. in section I in FIG. 1). This results in a substantially constant rate of heat transfer between the process fluid and the cold gas throughout section I. Thus, in one aspect the present process permits heat transfer to take place with high efficiency (usually absent from processes in which the refrigerant is a cold gas because of the low heat capacity of gaseous substances).

The cold gas serves as an intermediate heat transfer fluid between the cryogenic liquid in evaporator 18 and the process fluid in the heat exchanger tube 30*a* preventing the process fluid from freezing.

Typically, the cryogenic cold gas traveling down to the bottom of Section I of the heat exchanger housing will remain very cold, e.g., −195° C. when liquid nitrogen is used as the cryogenic liquid and therefore cold nitrogen gas is used as the cold gas.

The baffles 39 cause the cold gas to flow in a serpentine path and in the same general direction as the lay of the heat exchanger tube 30 horizontal fins 33. This improves the heat exchange since there is increased surface area contact between the cold gas and the fins 33. The heat exchanger fins 33 are used to reduce piping length since the refrigerant driving force has been reduced by using the warmer cryogenic cold gas instead of the colder cryogenic liquid.

It is an advantage of the invention that it maintains the cryogenic cold gas temperature and refrigeration (sensible heat) load which provides a high heat transfer rate. However, it is even more economically attractive if the cold gas at the end of the twin heat exchange stage (Section I) is not vented off at its low temperature but it is used to pre-cool the process fluid.

The cold gas at the bottom of housing 14 flows under the lowest baffle 39 and around the lower end of divider 38 into housing section II in which pre-cooling of the process fluid takes place. The cold gas from Section I flows upwardly in housing section II in counter current flow to the downward flow of the warm process fluid entering the heat exchanger tube 30*b*. This provides some pre-cooling of the process liquid before it enters housing section I in which the main cooling takes place. The spent cold gas exits from the top of housing section II at 37 to a suitable venting or recovery apparatus (not shown).

Therefore, the exhausting vent gas is heat exchanged during the counter-current flow with the incoming process fluid in housing section II. Housing section II is used as a heat recovery section to allow the cold gas leaving the unit to rise in temperature so that the overall thermal efficiency is improved. In section II, the temperature of the cryogenic cold gas can rise very rapidly since no additional refrigeration is re-supplied to the cryogenic cold gas (the twin heat transfer zone is only in Section I).

The heat exchanger unit 10 is thus able to convert all of the latent heat of the cryogenic liquid refrigerant into sensible heat without mixing the cryogenic liquid refrigerant with spent gas which would undesirably increase refrigerant volume. Yet, the unit can maintain a low temperature and refrigeration value of the cold gas to maximize and maintain the heat transfer driving force whether the process fluid is flowing in a direction counter-current or co-current to the refrigerant. It is another advantage of the invention that the temperature of the process fluid can be dropped rapidly through a large temperature range and without either the fluid or the wall of the heat exchanger freezing.

Figure 2:
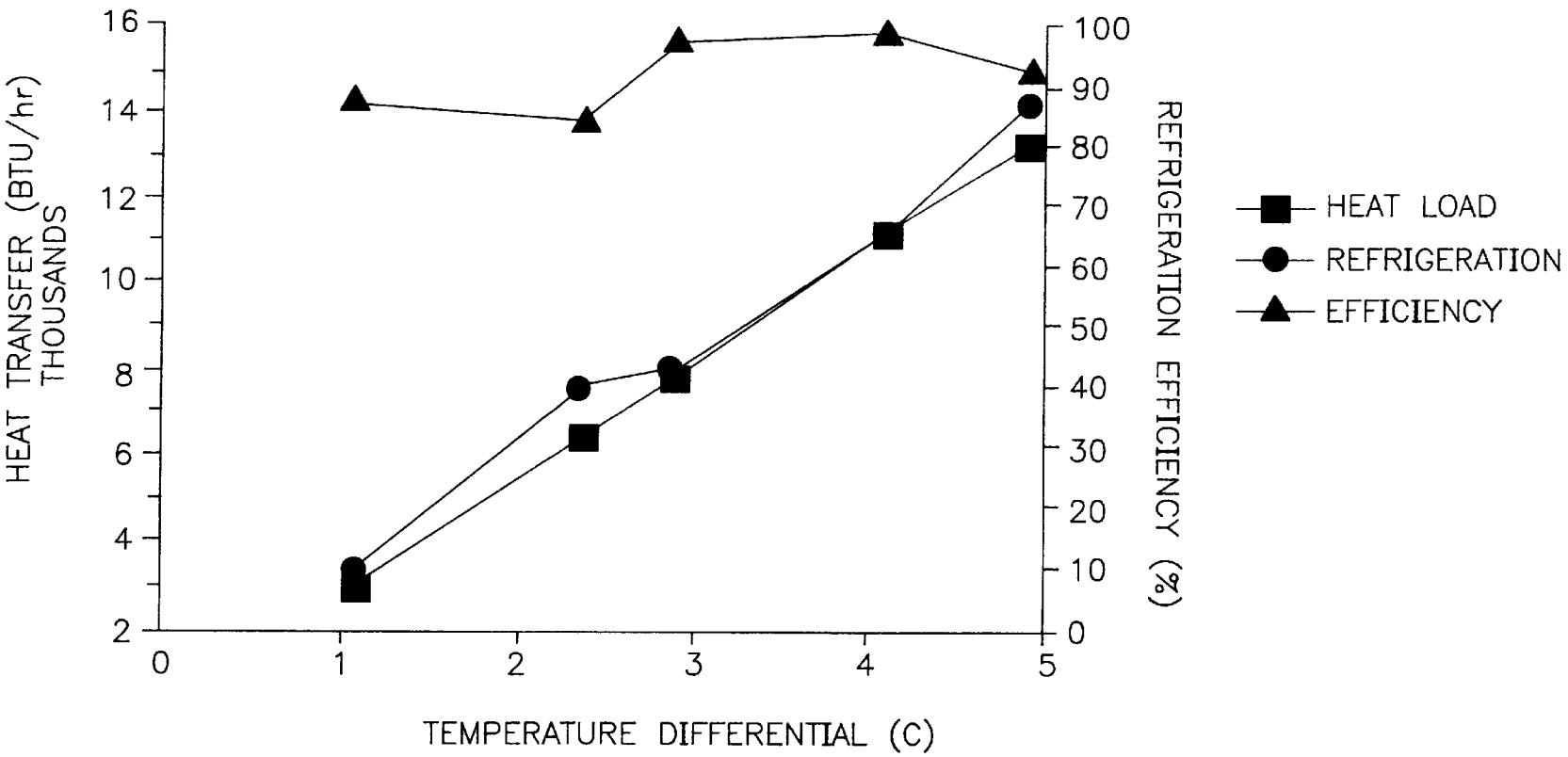
FIG. 2 is a graph showing process efficiencies in a heat exchanger unit of the type of FIG. 1.

A test was carried out using the unit 10 of FIG. 1 with a housing 14 (column) 5 feet high, one (preferably finned) evaporator tube 18, and two (preferably finned) heat exchanger tubes 30*a*, 30*b* each of ½ inch diameter. Using water as the process fluid flowing at 3 gallons per minute through the heat exchanger tubes 30, refrigerant loading and process efficiency were obtained as shown in FIG. 2. As seen, the unit supplied 13,000 BTU/hr of refrigeration while the process liquid received 12,000 BTU/hr of heat load. That is, the refrigeration was transferred with at least about 85% efficiency. No freezing was observed with the unit running at the illustrated conditions of flow and set points. The initial temperature of the water was 16° C. The cryogenic liquid was liquid nitrogen initially at −195° C.

The heat transfer rate of the present invention remains substantially constant from a unit length traveled by the refrigerant (cold gas) to the immediately adjacent unit length. Over the entire twin heat exchange section of the heat exchange process, the rate of heat transfer decreases slowly and substantially linearly. This is not the case in any of the prior art processes.

Figure 3:
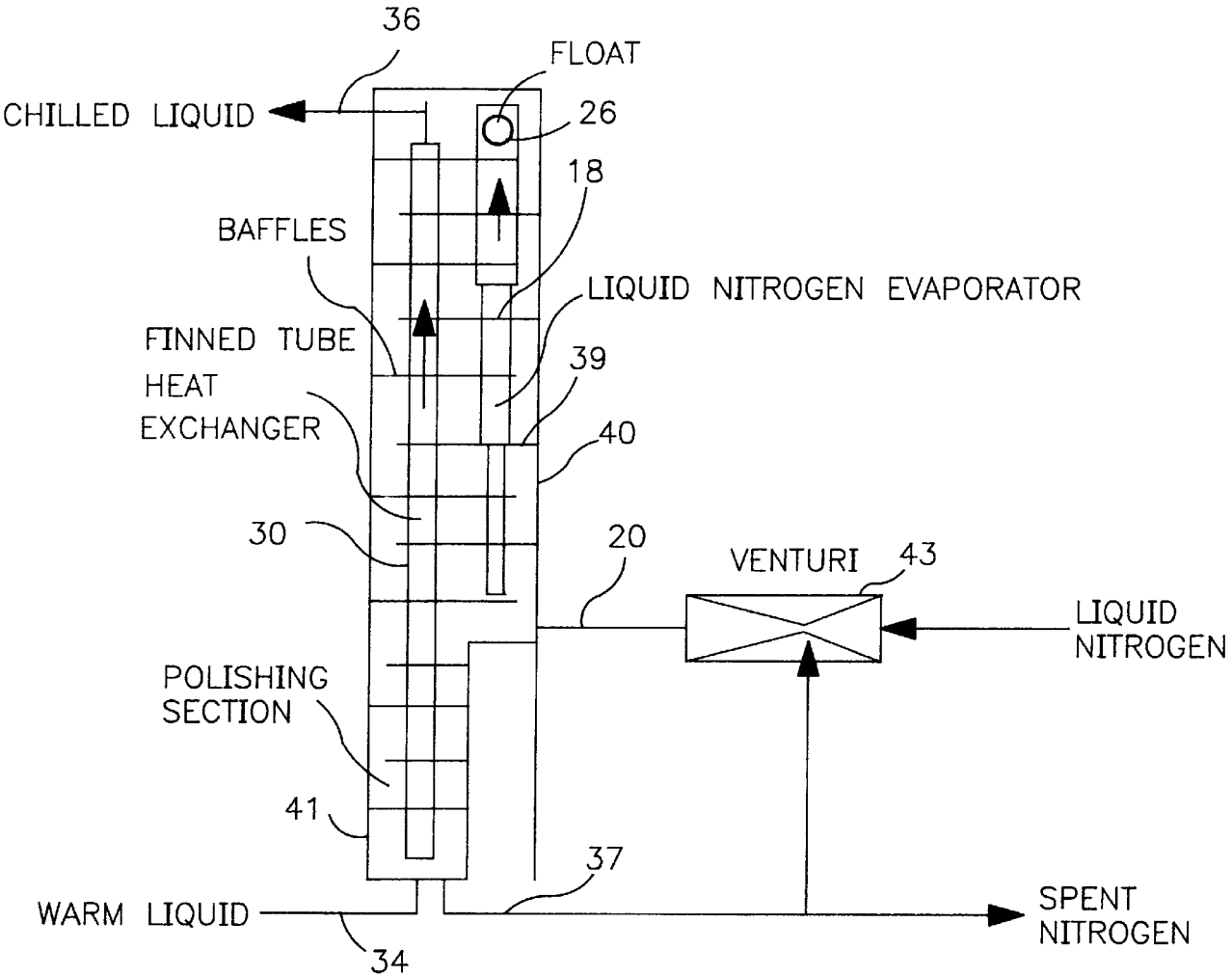
FIG. 3 is a schematic diagram of another embodiment of heat exchanger unit.

FIG. 3 shows a heat exchanger unit according to the invention but of more compact design that does not use the section II of the housing of FIG. 1. In FIG. 3, the same reference numerals are used for the same components as in FIG. 1.

Here, the housing 40 has a downwardly extending section 41. The evaporator 18 is located in the shorter housing section and receives the cryogenic liquid refrigerant over line 20 at its lower end. The cryogenic liquid moves upwardly and vaporizes to exit into the housing from the top end of the evaporator 18. A single finned heat exchanger tube 30 extends the length of the housing 40, including the elongated housing section 41, and receives the process fluid to be cooled at its bottom end from supply line 34. The lower section of the heat exchanger tube 18 in housing extension 41 does not oppose any part of the evaporator 18 in which the cryogenic liquid flows.

A plurality of horizontal baffles 39 extend partially across the housing interior from the inner wall of housing 40 alternating from opposing sides to define a serpentine flow path for the cold gas.

In the operation of the exchanger unit of FIG. 3, the cryogenic liquid enters the lower end of evaporator 18 and travels upwardly exiting as a cold gas vapor from the evaporator upper end. The warm process liquid to be cooled enters the heat exchanger tube 30 lower end and flows upwardly. The cryogenic cold gas from evaporator 18 travels downwardly in the housing in a serpentine path as determined by the baffles 39. Heat exchange takes place between the cold gas and the process liquid flowing in the countercurrent direction in heat exchanger tube 30.

The cryogenic liquid flowing in the evaporator 18 also cools the cold gas in the housing as it travels the serpentine path between the baffles 39. Here also there is no contact between the cryogenic liquid refrigerant and the heat exchanger tube so that there is no freezing.

The housing extension 41 and the portion of the heat exchanger tube 30 therein serve as a heat recovery section. That is, the entering warm process liquid is cooled somewhat in housing extension 41 as the cold gas loses much of its cooling capability and exits at the lower end of the housing extension. The thermal efficiency of the unit of FIG. 3 is not as good as the unit of FIG. 1 but it is more economical to construct (lower capital cost).

For a process fluid having a higher temperature freezing point, it is sometimes desirable to make the temperature of the cold gas providing the heat exchange warmer. This can be accomplished as shown in FIG. 3 by using a venturi 43 to entrain some of the spent warm cold gas exiting from the housing at 37 and recycle it back to mix with fresh cryogenic liquid entering the venturi 43. The mixed warmer cryogenic liquid applied from the venturi to the evaporator 18 increases the volumetric flow through the evaporator while the cold gas that interacts with the heat exchanger tube 30 becomes warmer. The overall enthalpy being transferred will be reduced. Therefore, the venturi 43 is desirable only if the operating temperature of the exchanger unit is very close to the freezing point of the process fluid. For example, if the process fluid is water, a venturi would be used if the operating temperature of the exchanger unit was −3° C.

Figure 4:
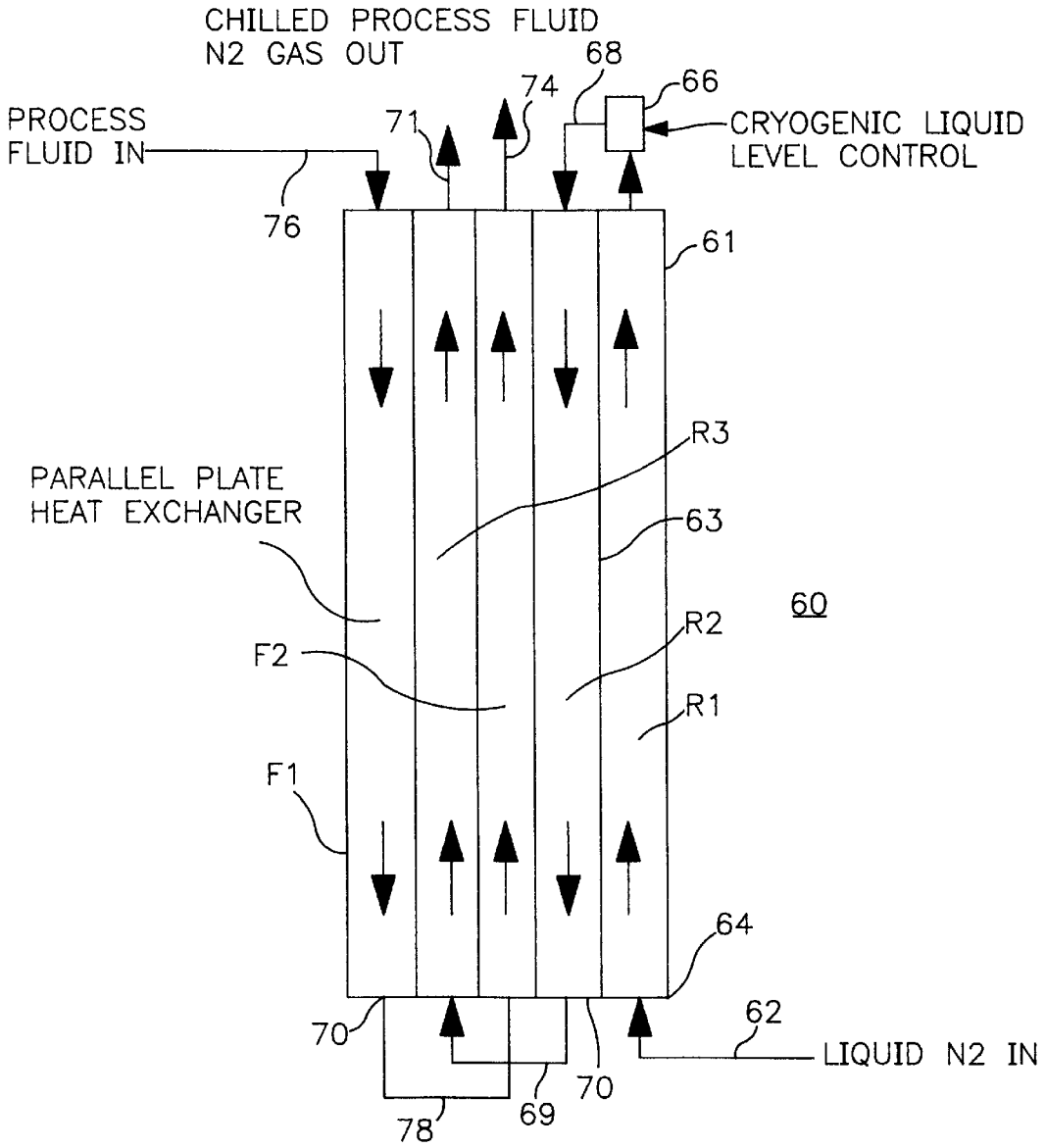
FIG. 4 is a schematic diagram of a multi-pass heat exchanger unit.

FIG. 4 shows a parallel plate heat exchanger 60 for effecting multiple passes of the process fluid with the cold gas refrigerant. The exchanger 60 has a housing 61 that is divided by parallel plates or panels 63 of a suitable material into refrigerant carrying sections R1, R2 and R3 and process fluid carrying sections F1 and F2. Refrigerant sections R1 and R2 are adjacent and section R1 receives the cryogenic liquid over conduit 62 at its inlet 64. The cryogenic liquid flows upwardly in section R1 and exits at the upper end where a float and electronic sensor 66 are placed to stop the overflow of the cryogenic liquid if there is a process upset. The cryogenic liquid vaporizes into a cold gas in section R1 and passes through a conduit 68 into the second refrigerant section R2. The cold gas flows downwardly in section R2 and exits through a conduit 69 to flow into the third refrigerant section R3 in which it flows upwardly to exit the unit at outlet 71 in gaseous form. Section R3 is separated from section R2 by process fluid section F2.

The process fluid enters the top of section F1 from an inlet conduit 76, flows downwardly in F1 and exits through a conduit 78 at its lower end to flow upwardly in process fluid section F2. Section F2 is sandwiched between refrigerating sections R2 and R3. The process fluid exits the heat exchanger unit through outlet 74 at the upper end of section R2. In FIG. 4 the solid arrows show the flow direction of the process liquid and the broken line arrows the flow direction of the cryogenic liquid and cold gas.

The cryogenic liquid entering the exchanger at inlet 64 is boiled off and vaporized into cold cryogenic gas as it makes a first pass through the heat exchanger section R1. The vaporized cold gas enters section R2. In the second pass through section R2, the cold vaporized gas is heat exchanged with the process fluid in section F2 through the panel 63 between the two sections, to cool the fluid. A third pass or more can be used to polish the remaining refrigeration. This is accomplished in the heat exchanger unit of FIG. 4 by using the section R3 to perform heat exchange with the process fluid flowing in section F1. The object is to keep the cryogenic liquid in the first pass through R1 from overflowing or flooding the second pass through R2 where the process fluid in F2 will come in contact only with the vaporized cold gas and not the cryogenic liquid itself.

A back-pressure regulator (not shown in any of the figures) is preferably provided for the spent cold gas at the exit (37 in FIGS. 1 and 3; 71 in FIG. 4) of the spent cold gas from the heat exchanger unit. This regulator permits the system to deliver the spent cold gas at a pressure desired by the user of the heat exchanger. This spent cold gas can thus be "recycled" into another application calling for pressurized gas at essentially no additional cost to the user of the heat exchanger unit of the present invention.

The freezer units of the invention provide effective cooling of a process fluid while minimizing the danger of causing freezing of any part of the exchanger.

The present invention can be practiced in connection with any process fluid and any cryogenic liquid. Nonlimiting examples of process fluids include individual substances, as well as reaction or product mixtures that include a liquid or gaseous phase, such as aqueous (or organic) solutions and suspensions or emulsions, such as organic hydrocarbon mixtures (alkanes, alkenes, aromatics, olefins and mixtures thereof) or gases (e.g. $CO_2$, $CH_4$, ethylene and other volatile hydro-carbon gases); nonlimiting examples of cryogenic liquids include helium, oxygen, argon, and carbon monoxide. The preferred cryogenic liquid is liquid nitrogen.

Specific features of the invention are shown in one or more of the drawings for convenience only, as each feature may be combined with other features in accordance with the invention. Alternative embodiments will be recognized by those skilled in the art and are intended to be included within the scope of the claims.

We claim:

1. A heat exchanger unit comprising:

a housing;

an evaporator in said housing for receiving a cryogenic liquid, the cryogenic liquid flowing in said evaporator and vaporizing into a cold gas that flows into said housing;

a heat exchanger in said housing through which a process fluid to be cooled flows;

the cold gas produced by said evaporator being in a first heat exchange relationship with said heat exchanger to effect heat transfer and cooling of said process fluid, and in a second heat exchange relationship with said evaporator to supply heat of vaporization to said vaporizing cryogenic liquid flowing in said evaporator, and wherein the heat of vaporization of said cryogenic liquid replenishes the ability of said cold gas to cool said process fluid.

2. A heat exchanger unit as in claim 1 wherein each of said evaporator and said heat exchanger are vertical, the cryogenic liquid entering said evaporator flowing in a first direction therein and exiting as a cold gas that flows in a second direction opposite to said first direction.

3. A heat exchanger unit as in claim 2, wherein the process fluid flows in a direction countercurrent to the cold gas.

4. A heat exchanger unit as in claim 1 wherein the process fluid flows in a direction cocurrent to the cold gas.

5. A heat exchanger unit as in claim 1 wherein each of said evaporator and said heat exchanger are horizontal.

6. A heat exchanger unit as in claim 2 wherein said heat exchanger is spaced from said evaporator within said housing, the second heat exchange occurring between the cryogenic liquid in said evaporator and the cold gas said cold gas flowing within a portion of said housing other than the evaporator and the heat exchanger.

7. A heat exchanger unit as in claim 2 further comprising a plurality of baffles extending transversely of a side-wall of said housing to direct the cold gas flowing in said second direction in a serpentine path, a part of which path is parallel to said evaporator and said heat exchanger.

8. A heat exchanger unit as in claim 2 further comprising a second heat exchanger extending vertically in said housing and spaced from said evaporator and said first named heat exchanger, said second heat exchanger receiving the process fluid at one end for flowing therethrough in said second direction, said second heat exchanger connected to said first named heat exchanger to supply the process fluid thereto.

9. A heat exchanger unit as in claim 8 further comprising a vertical divider wall in said housing dividing the interior of said housing into a first section in which said first named heat exchanger and said evaporator are located and a second section in which said second heat exchanger is located, the cold gas flowing in said second direction in said first housing section to effect heat exchange with the process fluid in said first named heat exchanger and flowing in said first direction in said second housing section to effect heat transfer with the process fluid flowing in said second heat exchanger in said second direction.

10. A heat exchanger unit as in claim 9 further comprising a plurality of baffles in said first housing section extending transverse to said divider wall to direct the flow of cold gas flowing in said second direction in said first housing section in a serpentine path, a part of which path is parallel to said evaporator.

11. A heat exchanger unit as in claim 4 wherein said housing has an extension and said heat exchanger has a part in said housing extension extending beyond said evaporator.

12. A heat exchanger unit as in claim 2 further comprising a plurality of fins on said heat exchanger.

13. A heat exchanger unit as in claim 1 wherein said housing further comprises a panel dividing the housing into an evaporator section for receiving the cryogenic liquid which evaporates into a cold gas, and a heat exchanger section in which the process fluid flows, heat exchange taking place through said panel between the cold gas and the process fluid, and between the cold gas and the evaporating cryogenic liquid.

14. A heat exchanger unit as in claim 13 wherein said evaporator section is divided into first and second subsections by a panel, the cryogenic liquid received in said evaporator first subsection and evaporating into the cold gas which is supplied to said evaporator second subsection, heat exchange taking place between the cold gas flowing in said evaporator second subsection and the process fluid flowing in said heat exchanger section.

15. A heat exchanger unit as in claim 14 wherein said heat exchanger section is divided by a panel into first and second subsections, said heat exchanger first subsection being adjacent to said evaporator second subsection, and wherein said evaporator section further comprises a third subsection to receiving the cold gas from said second evaporator subsection, said heat exchanger second subsection located between said evaporator second and third subsections.

16. A heat exchanger unit as in claim 13 wherein the cold gas in said evaporator section and said heat exchanger section flow in opposite directions while effecting heat exchange.

17. A heat exchanger unit as in claim 15 wherein the cold gas in said evaporator second subsection and said heat exchanger section flow in opposite directions while performing heat exchange.

18. A heat exchanger unit as in claim 16 wherein the cold gas in said evaporator second subsection and said heat exchanger first subsection flow in opposite directions and the cold gas in said evaporator third subsection and heat exchange second section also flow in opposite directions while effecting heat exchange.

19. A process for cooling a flowing process fluid comprising flowing a cold gas refrigerant comprising a vaporized cryogenic liquid (a) in a first heat exchange relationship with said process fluid thereby cooling said process fluid and (b) in a second heat exchange relationship with said cryogenic liquid causing said liquid to vaporize and form additional cold gas and employing the heat of vaporization of said liquid to replenish the ability of said refrigerant to cool said process fluid.

* * * * *